US005585896A

United States Patent [19]

Yamazaki et al.

[11] Patent Number: 5,585,896

[45] Date of Patent: Dec. 17, 1996

[54] IMAGE FORMING APPARATUS WITH A CONTACT MEMBER CONTACTING AN IMAGE CARRIER

[75] Inventors: Kouichi Yamazaki, Yokohama; Sadao Takahashi, Tokyo; Nobuo Kikuchi, Kawagoe; Kentaro Matsumoto, Ichikawa; Tadashi Hayakawa, Tokyo; Yoshiaki Miyashita, Kawasaki; Takeshi Tabuchi, Kawaguchi; Naomi Misago, Tokyo; Hirohisa Otsuka, Kawaguchi, all of Japan

[73] Assignee: Ricoh Company, Ltd., Tokyo, Japan

[21] Appl. No.: 338,176

[22] Filed: Nov. 9, 1994

[30] Foreign Application Priority Data

| | | | |
|---|---|---|---|
| Nov. 9, 1993 | [JP] | Japan | 5-279397 |
| Dec. 13, 1993 | [JP] | Japan | 5-341916 |
| Mar. 11, 1994 | [JP] | Japan | 6-041301 |

[51] Int. Cl.[6] ..... G03G 15/02

[52] U.S. Cl. ..... 355/219; 355/203; 361/221

[58] Field of Search ..... 355/219, 271, 355/274, 203–4, 246, 208–9, 276–7; 361/221, 225, 27, 103; 219/216; 374/22, 141, 143, 153

[56] References Cited

U.S. PATENT DOCUMENTS

| | | | |
|---|---|---|---|
| 3,809,855 | 5/1974 | Neal | 219/216 |
| 4,043,747 | 8/1977 | Ogiwara | 432/60 |
| 4,321,828 | 3/1982 | Grimes et al. | 73/351 |
| 4,638,397 | 1/1987 | Foley | 361/212 |
| 4,650,347 | 3/1987 | Shigemura et al. | 374/141 |
| 4,877,331 | 10/1989 | Schrörs et al. | 374/153 |
| 5,046,947 | 9/1991 | Endoh et al. | 432/60 |
| 5,276,483 | 1/1994 | Hasegawa et al. | 355/208 |
| 5,281,793 | 1/1994 | Gavin et al. | 219/216 |
| 5,287,155 | 2/1994 | Arai et al. | 355/285 |
| 5,290,643 | 3/1994 | Chen | 429/61 |
| 5,321,476 | 6/1994 | Gross | 355/271 |

FOREIGN PATENT DOCUMENTS

| | | |
|---|---|---|
| 0024154 | 2/1981 | European Pat. Off. . |
| 0537793 | 4/1993 | European Pat. Off. . |
| 4240549 | 6/1993 | Germany . |

OTHER PUBLICATIONS

Patent Abstracts of Japan, vol. 16, No. 511 (P–1441), Oct. 21, 1992, JP–A–04 186 381, Jul. 3, 1992.

Patent Abstracts of Japan, vol. 16, No. 155 (P–1338), Apr. 16, 1992, JP–A–04 006 567, Jan. 10, 1992.

*Primary Examiner*—Thu Anh Dang

*Attorney, Agent, or Firm*—Oblon, Spivak, McClelland, Maier & Neustadt, P.C.

[57] ABSTRACT

In an image forming apparatus, a charging member, image transfer member or similar contact member contacts an image carrier implemented as a photoconductive element. Even when a voltage is applied to the contact member in a relatively low temperature environment, the contact member is provided with an adequate charge potential or an image transfer potential.

16 Claims, 16 Drawing Sheets

IMAGE FORMING APPARATUS WITH A CONTACT MEMBER CONTACTING AN IMAGE CARRIER

FIELD OF THE INVENTION

BACKGROUND OF THE INVENTION

The present invention relates to an electrophotographic image forming apparatus having a charging member, image transfer member or similar contact member which is applied with a voltage in contact with a photoconductive element or similar image carrier with or without the intermediary of a paper.

DISCUSSION OF THE BACKGROUND

Generally, an image forming apparatus of the type described, e.g., a facsimile apparatus or a printer includes a charging device for charging a photoconductive element, or image carrier, and an image transfer device for transferring a toner image from the photoconductive element to a paper. The charging device and image transfer device have often been implemented by a corona discharger having a discharge wire made of tungsten and not contacting the object to be charged. The charging device implemented by a corona discharger has the following problems.

(1) A voltage as high as 4 kV to 8 kV has to be applied to the discharge wire in order to deposit a charge potential of 500 V to 800 V on the photoconductive element.

(2) Since most of the current from the discharge wire flows into a shield, only several percent of the total discharge current is available for charging the surface of the photoconductive element to the predetermined potential, obstructing efficient use of power.

(3) Corona discharge ionizes the air and generates a great amount of ozone, nitrogen oxides and other harmful substances. To prevent such substances from deteriorating the parts of the apparatus and the surface of the photoconductive element, the apparatus has to be provided with an ozone filter, a fan for generating a stream of air, etc.

(4) Images are apt to become irregular due to the contamination of the discharge wire.

In light of the above, there has been proposed a charging device having a charge roller or similar charging member which charges the photoconductive element in contact therewith when applied with a voltage. Such a contact type charging device is advantageous over the above-stated non-contact type device, as follows. The device reduces the voltage necessary for the predetermined charge potential to be deposited on the surface of the photoconductive element. The device produces a minimum of ozone during the course of charging and, therefore, eliminates the need for an ozone filter while simplifying an exhaust arrangement.

However, the problem with the contact-type charging device is that the charging efficiency, i.e., a ratio of the charge potential to the applied voltage, changes with a change in the surface temperature of the charge roller; the former decreases with a decrease in the latter. It follows that in the case of constant voltage control, a decrease in charging efficiency lowers the charge potential and, therefore, image density for a given applied voltage. In addition, the other process control, also using the charge potential as a reference value, becomes faulty.

To eliminate the above problems, Japanese Patent Laid-Open Publication No. 4-6567, for example, proposes an arrangement wherein the charge roller or similar charging member itself is heated to 35° C. to 55° C. so as to obviate defective charging even in a low temperature environment. To heat the charging member, a heat source is disposed in or in the vicinity of the charge member, or heat from a fixing device is fed to the charging member. For temperature adjustment, use is made of a thermostat or similar conventional temperature adjusting member.

By so controlling the temperature of the charge roller or similar contact member contacting the photoconductive element, it is possible to maintain a charge potential which does not degrade images. However, the heat heats not only the charging member but also the photoconductive element and other process units adjoining the heat source. As a result, toner collected from the photoconductive element after the image transfer is heated while it is returned to a developing device. This brings about so-called toner blocking and aggravates the cohesion of toner.

Japanese Patent Laid-Open Publication No. 4-186381, for example, teaches an improved charging device having a temperature sensor directly contacting the charge roller. In response to the output of the temperature sensor representing the surface temperature of the charge roller, the voltage to be applied to the roller is controlled to deposit a stable charge potential on the photoconductive element. This successfully eliminates the problems discussed above in relation to Laid-Open Publication No. 4-6567. In addition, since the temperature sensor directly contacts the charge roller, it can sense the surface temperature without regard to the ambient atmospheric temperature and, therefore, insures an adequate voltage.

However, even the charging device using a temperature sensor as stated above has some problems yet to be solved, as follows. Although the contact type charging scheme reduces the voltage required of the charge roller, compared to the non-contact type scheme using a corona discharger, a voltage as high as 1 kV to 2 kV is still necessary and effects the temperature sensor and other constituents in various ways. For example, when such a high voltage is applied to the charge roller, electric noise is apt to enter a control circuit, which controls the voltage to the charge roller, via the sensor contacting the charge roller. Moreover, short-circuiting is apt to occur due to a small breakdown voltage. This causes the control system to malfunction or, in the worst case, breaks it. Further, the sensor contacting the charge roller causes the roller to wear, causes toner and paper dust and other impurities to adhere to the roller, and produces noise while the charge roller rotates in contact with the sensor. Although these problems may be eliminated if the sensor is spaced apart from the charge roller, then the sensor fails to sense the surface temperature of the roller with accuracy.

The foregoing description has concentrated on a charge roller which is applied with a voltage in contact with a photoconductive element. However, it is also true with an image transfer roller which is applied with a voltage in contact with a photoconductive element with the intermediary of a paper. Specifically, in the case of constant voltage control, if the surface temperature of the image transfer member is low, a toner image cannot be efficiently transferred from the photoconductive element to the paper.

SUMMARY OF THE INVENTION

It is, therefore, an object of the present invention to provide an image forming apparatus having a charging member, image transfer member or similar contact member contacting an image carrier and insuring a desired charge potential or image transfer potential even when applied with a voltage in a relatively low temperature environment.

It is another object of the present invention to provide an image forming apparatus having a contact member of the kind mentioned which frees a control system from malfunctions and breakage when applied with a voltage.

It is another object of the present invention to provide an image forming apparatus having a contact member of the kind mentioned which prevents toner and impurities, including paper dust, from adhering to the surface thereof and does not produce noise due to rubbing.

It is another object of the present invention to provide an image forming apparatus having a contact member of the kind mentioned which obviates toner blocking and prevents the cohesion of toner from being aggravated.

It is another object of the present invention to provide an image forming apparatus which prevents, for example, a temperature sensor from causing the surface of a contact member of the kind mentioned to wear or break.

In accordance with the present invention, an image forming apparatus has a photoconductive element, a contact member applied with a voltage in contact with the photoconductive element, a voltage source for applying the voltage to the contact member, a temperature sensor for sensing the surface temperature of the contact member, a controller for controlling the voltage to be applied from the voltage source to the contact member in response to the output of the temperature sensor, and a moving mechanism for selectively moving the temperature sensor to a contact position where it contacts the surface of the contact member or to a non-contact position where it does not contact the contact member.

Also, in accordance with the present invention, an image forming apparatus has a photoconductive element, a contact member applied with a voltage in contact with the photoconductive element, a moving mechanism for selectively moving the contact member into or out of contact with the photoconductive element, a voltage source for applying the voltage to the contact member, a temperature sensor for sensing the surface temperature of the contact member, and a controller for controlling the voltage to be applied from the voltage source to the contact member in response to the output of the temperature sensor. The temperature sensor is located at a position where it contacts the surface of the contact member when the contact member and photoconductive element are spaced apart from each other or does not contact the surface when the contact member and photoconductive element are held in contact with each other.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the image forming apparatus in accordance with the present invention will be described.

1st Embodiment

Figure 1:
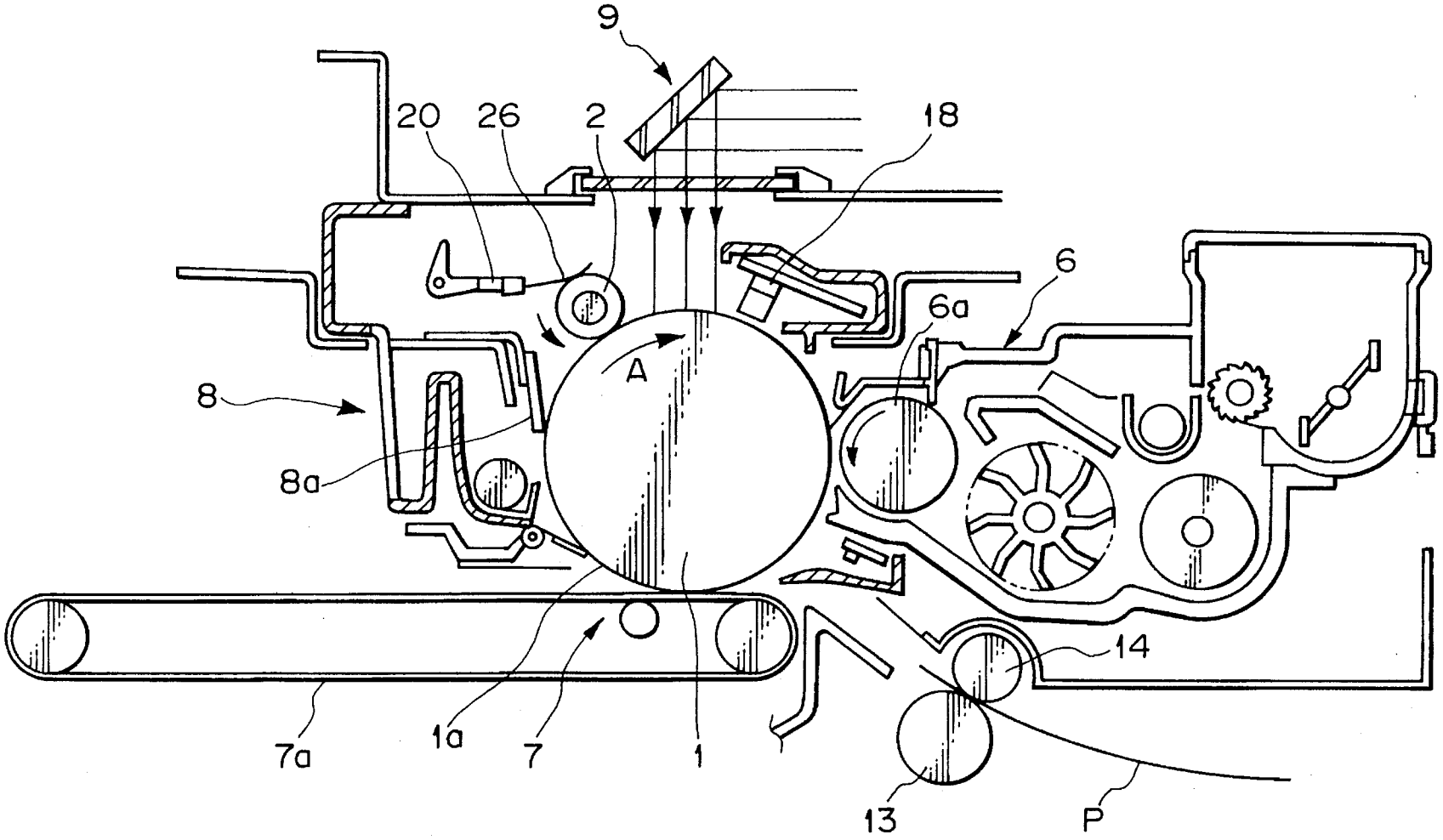
FIG. 1 is a section showing a first embodiment of the image forming apparatus in accordance with the present invention.

Referring to FIG. 1 of the drawings, an image forming apparatus has an image carrier implemented as a photoconductive element 1 by way of example. A charge roller, or charging member 2 is constantly held in contact with the drum 1. A voltage is applied to the charge roller 2 to cause it to charge the surface 1*a* of the drum 1 uniformly to a predetermined potential. While the drum 1 is rotated at a preselected peripheral speed in a direction A, the charge roller 2 is driven by the drum 1 at the same speed as the drum 1 and in the same direction at the position where the former contacts the latter. The drum 1 is driven by a drum driveline, not shown, including a timing belt, drive pulley and motor for driving them. The charge roller 2 is pressed against the drum surface 1*a* by a spring, which will be described later, at a pressure of, for example, 10 g/cm (substantially line-to-line contact). Arranged around the drum 1 are, in addition to the charge roller 2, an eraser 18, a developing unit 6, a contact type image transfer unit 7 having an endless belt 7a which is held in contact with the drum 2 like the charger roller 2, and a cleaning unit 8.

Imagewise light issuing from optics 9 (only a mirror is shown) is incident to the uniformly charged surface 1a of the drum 1, thereby electrostatically forming a latent image thereon. The eraser 18 trims the latent image, i.e., removes the electrostatic charge of the drum surface 1a outside of the size of a piece of paper P used. The latent image left on the drum surface 1a is developed by toner deposited thereon by a developing sleeve 6a included in the developing unit 6. As a result, the latent image is converted to a corresponding toner image.

The paper P is fed from a cassette, not shown, by a pick-up roller which is driven at a predetermined timing. A registration roller 13 in and a press roller 14 rotatable contact with the roller 13 stop once the paper P is fed from the cassette. Subsequently, the rollers 13 and 14 drive the paper P toward the image transfer unit 7, or image transfer position, such that the paper P accurately meets the toner image produced on the drum 1. The image transfer unit 7, applied with a bias, transfers the toner image from the drum 1 to the upper surface of the paper P, as viewed in FIG. 1. The paper P carrying the toner image thereon is separated from the drum 1 and then conveyed to a fixing unit, not shown. After the fixing unit has fixed the toner image on the paper P, the paper P is driven out of the apparatus to, for example, a copy tray. After the image transfer, the toner and impurities, including paper dust, left on the drum 1 are removed by a cleaning blade 8a included in the cleaning unit 8. Further, the potentials left on the drum 1 are dissipated by a discharger, not shown, so as to prepare the drum 1 for the next uniform charging by the charge roller 2.

Figure 2:
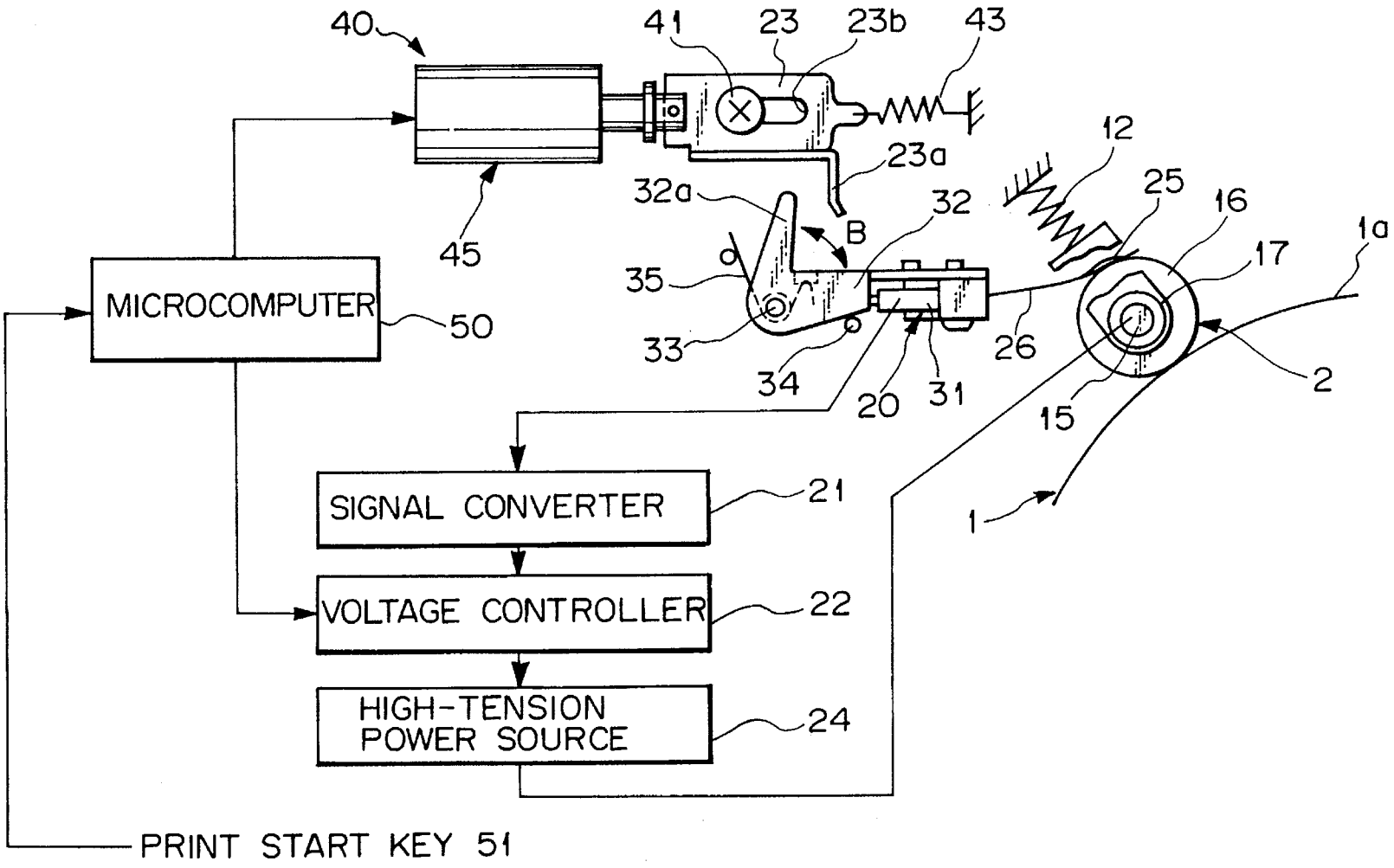
FIG. 2 is a view showing a photoconductive element, a charge roller contacting the element, and a temperature sensor included in the embodiment together with a control system.
Figure 7:
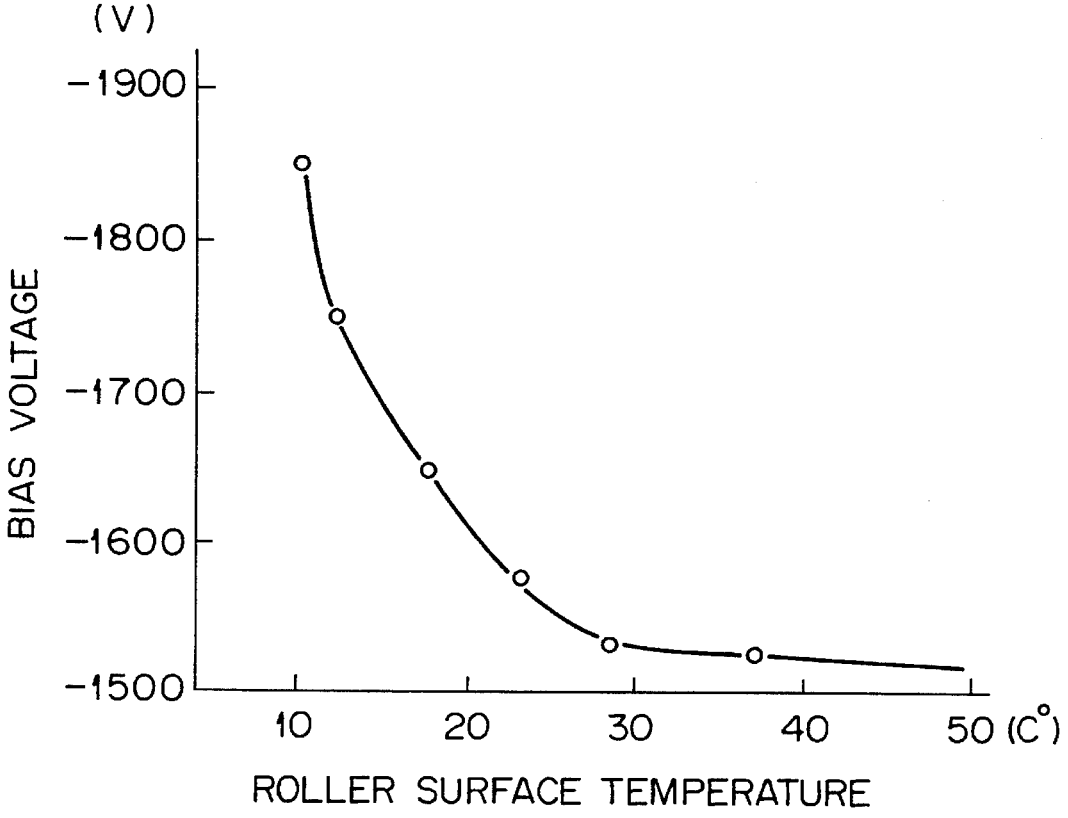
FIG. 7 is a graph indicating a relation between a bias voltage to a charge roller and the surface temperature of the roller.

As shown in FIG. 2, the charge roller 2 is made up of a core 15 made of iron or similar conductive metal, and a roller 16 covering the core 15 and made of EPDM (ternary copolymer of ethylene propylene dien or similar conductive rubber). The core 15 is rotatably supported by bearings 17 at opposite ends thereof. The bearings 17 are each biased toward the drum 1 by a spring 12 via a member which retains the bearing 17. In this configuration, the charge roller 2 is held in contact with the drum surface 1 with the axis thereof extending parallel to that of the drum 1. A high-tension power source, or voltage applying means, 24 applies a bias voltage to the core 15, so that the drum surface 1a is uniformly charged. As shown in FIG. 7, the bias voltage applied to the core 15 changes with a change in the surface temperature of the charge roller 2.

A temperature sensor 20 is responsive to the surface temperature of the charge roller 2 and is implemented by a thermistor or similar temperature sensing means. The temperature sensor 20 includes a sensing element 25 contacting the charge roller 2. As the electric resistance of the sensing element 25 changes in response to the temperature of the charge roller 20, a signal converter 21 reads it by converting it to a voltage or similar electric signal. A voltage controller, or voltage control means, 22 controls the voltage to be applied from the power source 24 to the charge roller 2 in response to the output of the signal converter 21. Specifically, in response to the output of the signal converter 21, the voltage controller 22 looks up a preselected control table (see FIG. 7) to determine a correction amount with respect to a reference voltage. Then, the voltage controller 22 delivers a signal to the power source 24 for causing it to apply a bias voltage with the correction amount to the charge roller 2.

Figure 3:
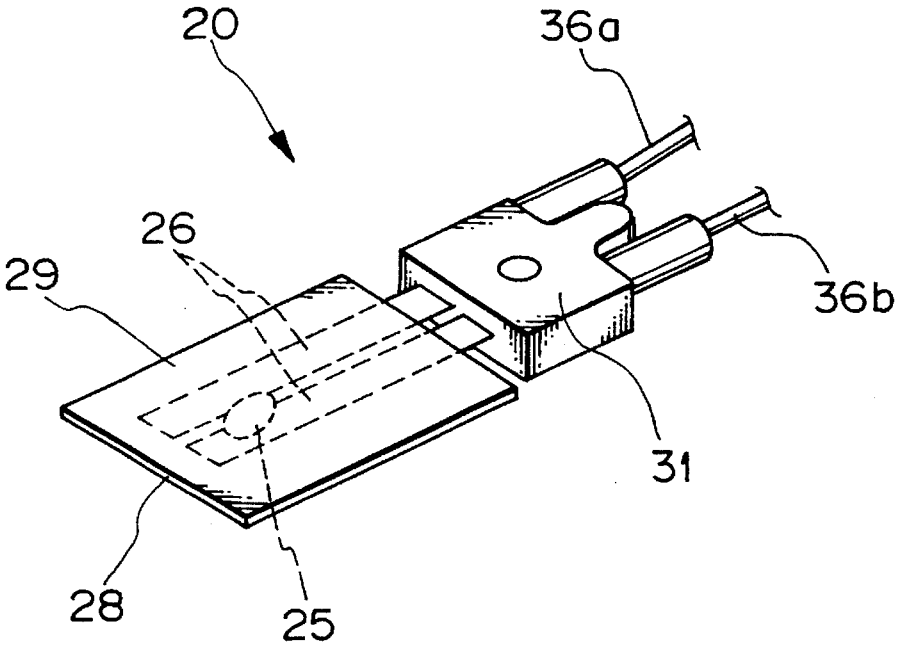
FIG. 3 is a perspective view of the temperature sensor.
Figure 4:
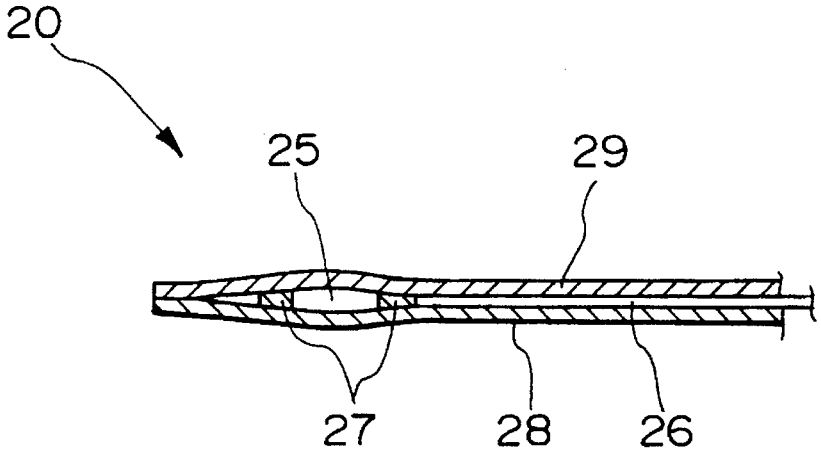
FIG. 4 is a section of the temperature sensor.

As shown in FIG. 3, the temperature sensor 20 has two parallel conductive leaf springs 26. As shown in FIG. 4, the sensing element 25 is held between the free end portions of the springs 26 and is temporarily affixed thereto by silicone grease 27. As also shown in FIG. 4, an about 10 μm thick film 28 and a film 29 of substantially the same thickness as the film 28 are adhered to each other with the intermediary of the springs 26; the latter lies above the former. The film 28 is made of, for example, polyimide amide while the film is made of, for example, fluorine-contained resin (Teflon). The sensing element 25 contacts the surface of the charge roller 2 via the film 28 and changes the resistance thereof in association with temperature. Since the film 28 contacts the surface of the charge roller 2, it should preferably have the same hardness as the surface of the charge roller 2 so as not to roughen it or cause irregular charging to occur.

As shown in FIG. 3, the springs 26 are spaced apart from each other and affixed at one end thereof to an insulating member 31 made of resin. The springs 26 are respectively connected to leads 36a and 36b in the insulating member 31. As shown in FIG. 2, the insulating member 31 is affixed to a bracket 32. The bracket 32 is rotatable about a shaft 33 in a direction indicated by a double-headed arrow B in FIG. 2. A torsion spring 35 is wound round the shaft 33 to constantly bias the springs 26 toward the charge roller 2. The angular movement of the springs 26 is limited when the lower edge of the bracket 32 abuts against a stop 34.

The bracket 32 includes a lever portion 32a. A moving mechanism 40 includes a release lever 23 having an actuating end which is engageable with the lever portion 32a. The moving means 40 selectively moves the sensing element 25 of the temperature sensor 20 to an operative or contact position shown in FIG. 2 via the film member 28, illustrated in FIG. 4, or to an inoperative or non-contact position shown in FIG. 5. In the operative position, the sensing element 25 contacts the surface of the charger roller 2. In the moving mechanism 40, the release lever 23 is formed with a slot 23b in which a stepped screw 41 is received, so that it is movable in the right-and-left direction as viewed in FIG. 5. The release lever 23 is constantly pull to the right, as viewed in FIG. 5, by a tension spring 43. A solenoid 45 moves the release lever to the left, as viewed in FIG. 5, against the action of the tension spring 43 when energized.

Figure 6:
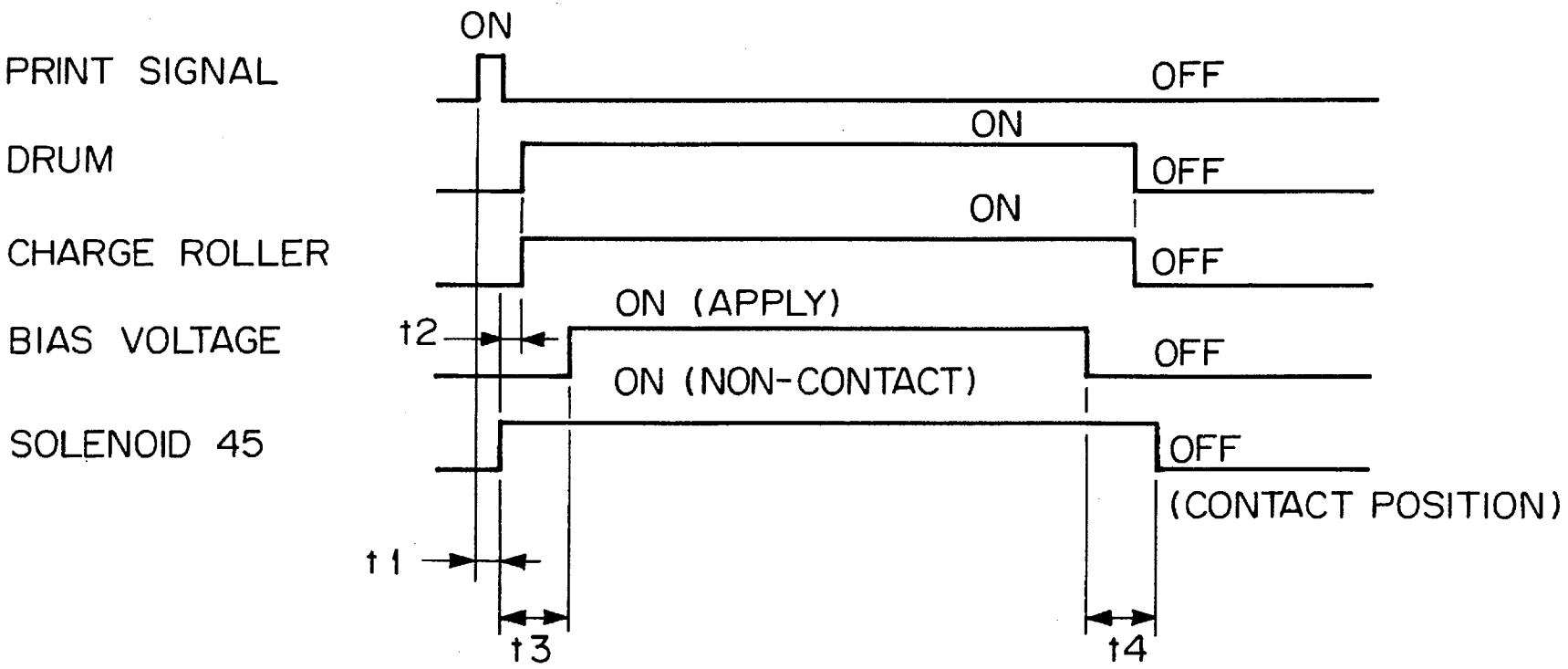
FIG. 6 is a timing chart demonstrating the operation of the embodiment.

As shown in FIG. 6, the voltage controller 22 is so controlled as not to apply a voltage from the power source 24 to the charge roller 2 when the temperature sensor 20 is held in the above-mentioned operative position. This is executed by a microcomputer 50, FIG. 2, which controls the entire image forming apparatus. The microcomputer 50 has a CPU (Central Processing Unit) for performing various kinds of decisions and processing, a ROM (Read Only Memory) or program memory storing various kinds of programs and fixed data necessary for various operations to occur at respective timings, a RAM (Random Access Memory) available for storing input data and output data from the CPU, and an I/O (Input/Output) circuit.

When a print start key 51 provided on an operation panel, not shown, is pressed to start an image forming operation, the microcomputer 50 receives a print signal from the key 51. Although not shown in FIG. 2, keys are also arranged on the operation panel for allowing the operator to select a desired paper size, image density and other image forming conditions. Signals from these keys are also applied to the microcomputer 50. The microcomputer 50 sends a drive signal to a driveline for driving the drum 1, and sends a signal to the solenoid 45 for moving the temperature sensor 20 to the inoperative or non-contact position.

Specifically, as shown in FIG. 6, on receiving a print signal from the print start key 51, the microcomputer 50 energizes, before applying the bias voltage to the charge roller 2, the solenoid 45 on the elapse of a period of time t1. In response, the solenoid 45 pulls the release lever 23 from the position shown in FIG. 2 to the position shown in FIG. 5 against the action of the tension spring 43. As a result, the actuating end 23*a* of the release lever 23 abuts against the lever portion 32*a* of the bracket 32 and urges it to the left, as viewed in FIG. 5, thereby causing the bracket 32 to rotate counterclockwise about the shaft 33. Hence, the temperature sensor 20 mounted on the bracket 32 is rotated in the same direction as the bracket 32. Consequently, the sensing element 25 affixed to the leaf springs 26 is moved away from the charge roller 2; the sensor 20 is brought to the inoperative position shown in FIG. 5.

Figure 5:
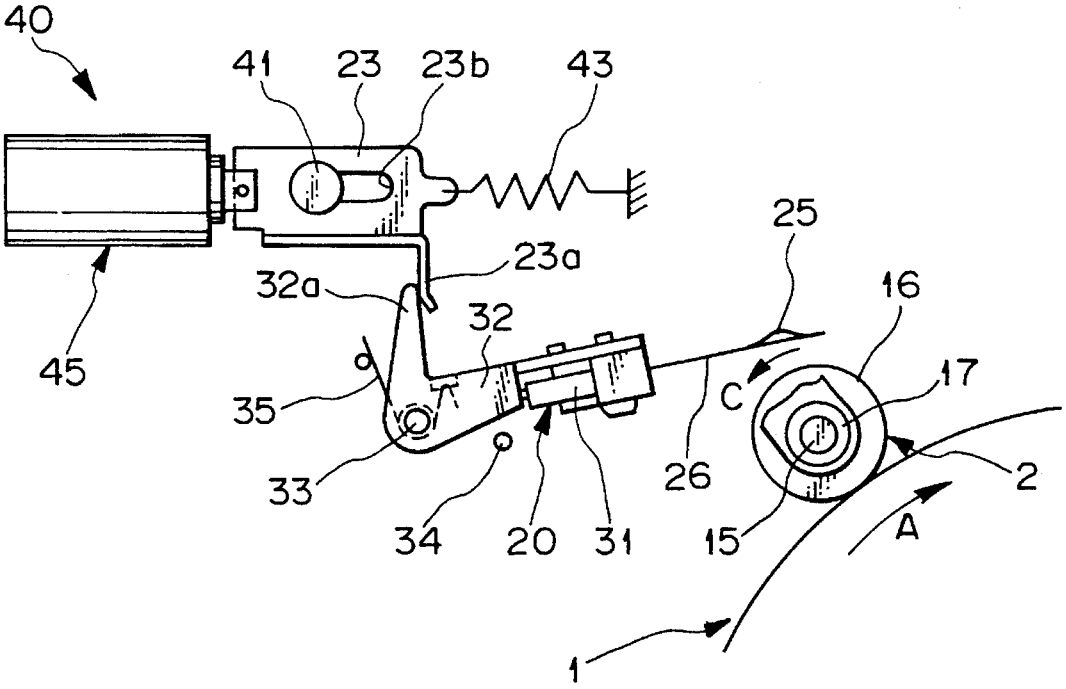
FIG. 5 shows the temperature sensor moved to an inoperative position by a moving mechanism.

On the elapse of a period of time t2, FIG. 6, since the turn-on of the solenoid 45, the driveline associated with the drum 1 is driven to rotate the drum 1 in the direction A, as shown in FIG. 5. The drum 1, in turn, rotates the charge roller 2, contacting the drum surface 1*a*, in a direction indicated by an arrow C.

Further, after a period of time t3 (longer than t2) has expired since the turn-on of the solenoid 45, the power source 24, FIG. 2, applies a bias voltage to the charge roller 2. When a period of time t4 expires since the end of the voltage application to the charge roller 2, the solenoid 45 is turned off.

Hence, in the illustrative embodiment, so long as the solenoid 45 is not turned off and maintains the temperature sensor 20 in the operative position, i.e., maintains the sensing element 25 in contact with the drum surface 1*a* via the film 28, FIG. 4, no voltages are applied from the power source 24 to the charge roller 2. That is, a voltage is applied to the charge roller 2 only when the solenoid 45 is turned on to hold the sensor 20 in the inoperative position shown in FIG. 5. In this condition, the high voltage applied to the charge roller 2 does not electrically effect the sensor 20 at all since the sensor 20 is remote from the charge roller 2. Moreover, the apparatus is free from malfunctions since electric noise is prevented from entering the control system via the sensor 20 and since the circuitry is free from short-circuiting due to short breakdown voltage.

The sensor 20 shown in FIG. 4 has the sensing element 25 thereof contacting the charge roller 2 via the insulative film 28, thereby reducing frictional resistance between it and the roller 2 and setting up insulation. Since the sensing element 25 is not more than about 10 μm thick in consideration of response, it may not have a sufficient breakdown voltage against the high voltage to be applied to the charge roller 2. However, this problem is eliminated since the sensor 20 is spaced apart from the charge roller 2 in the event of application of such a high voltage to the charge roller 2.

While a voltage is applied to the charge roller 2, the sensor 20 is spaced apart from the charge roller 2, as stated above. Hence, since the surface of the charge roller 2 is not rubbed by the sensor 20, it does not wear and prevents toner and impurities, including paper dust, from adhering thereto. In addition, noise attributable to rubbing is obviated.

The bias voltage to the charge roller 2 is corrected with respect to a reference voltage in matching relation to the surface temperature of the charge roller 2 sensed by the sensor 20, as stated previously. The correction may be effected in accordance with a specific relation between the surface temperature of the charge roller 22 and the bias voltage shown in FIG. 7.

As stated above, the illustrative embodiment controls the bias voltage to be applied to the charge roller 2 on the basis of the surface temperature of the charge roller 2 sensed by the sensor 20. Hence, even when the apparatus is used in a relatively low temperature atmosphere (e.g., lower than 25° C.), defective charging and, therefore, defective images, including low density images, are eliminated.

Figure 8:
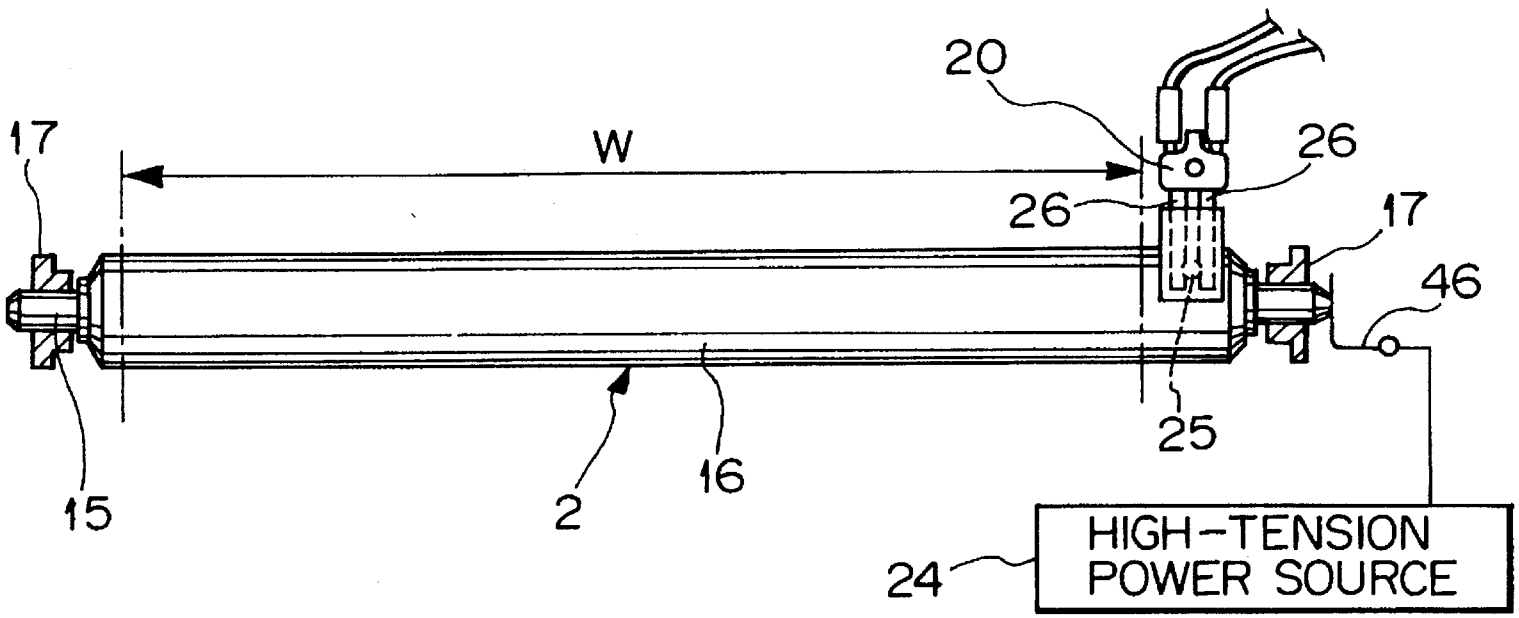
FIG. 8 shows the temperature sensor contacting the charge roller outside of an effective image forming region.

As shown in FIG. 8, the sensor 20 should preferably be positioned such that the sensing element 25 contacts the charge roller 2 via the film 28, FIG. 4, at the outside of an effective image forming region W defined on the roller 2. Then, the sensor 20 will not contact the effective image forming region W of the charge roller 2, protecting it from scratches and, therefore, insuring attractive images. In FIG. 8, the reference numeral 46 designates a leaf spring resiliently and slidably contacting the core 15 of the charge roller 2. The voltage from the power source 24 is applied to the leaf spring 46.

2nd Embodiment

Figure 9:
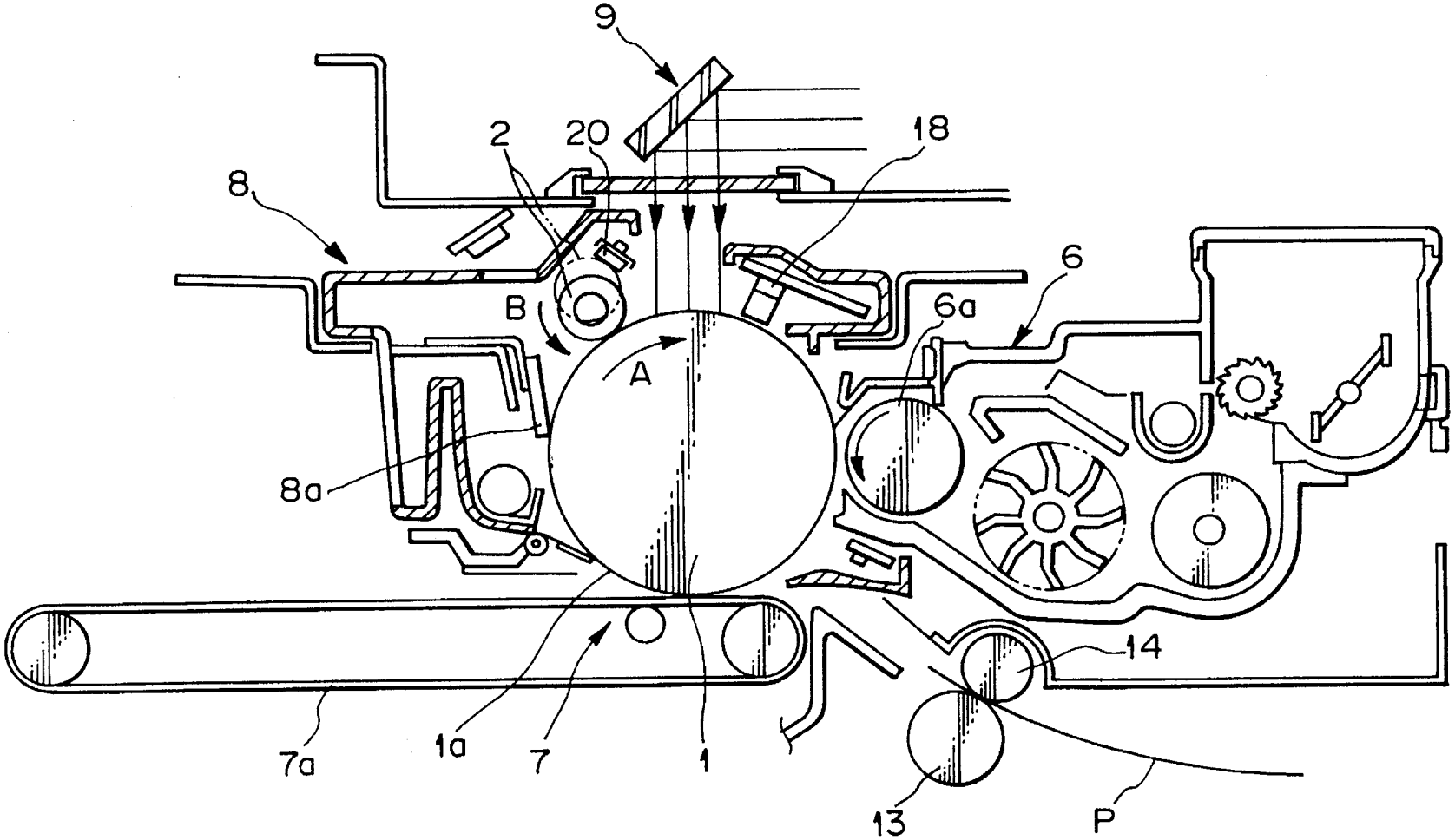
FIG. 9 is a section showing a second embodiment of the present invention.

A second embodiment of the present invention is shown in FIG. 9. In FIG. 9, the constituent parts corresponding to the parts shown in FIG. 1 are designated by the reference numerals. This embodiment is characterized in that the charge roller 2 is movable into and out of contact with the drum 1.

Figure 10:
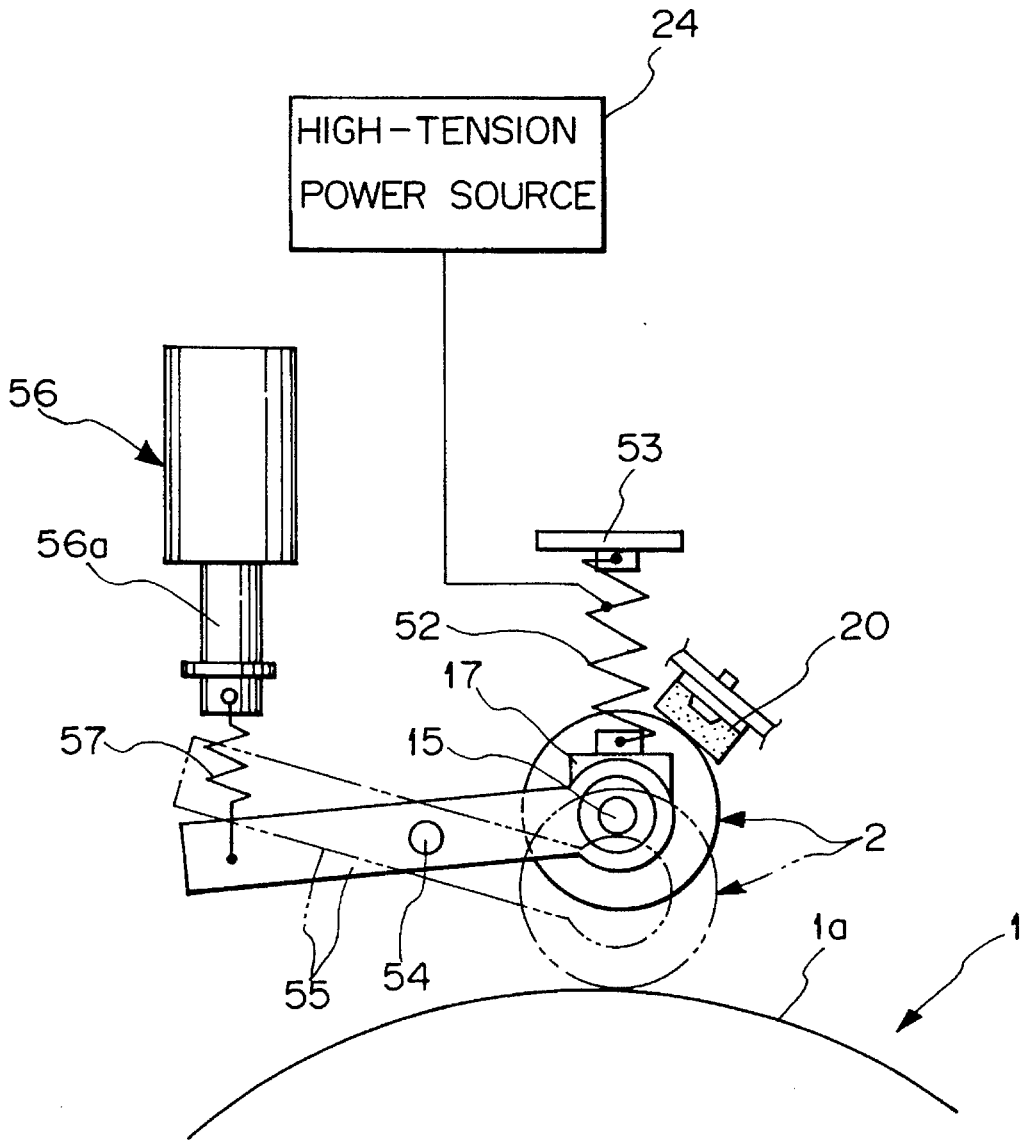
FIG. 10 shows a specific mechanism for moving a charge roller included in the second embodiment into and out of contact with a photoconductive element.

FIG. 10 shows a specific mechanism for moving the charge roller toward and away from the drum 1. As shown, the core 15 of the charge roller 2 is rotatably supported by the bearings 17 which are, in turn, constantly biased away from the drum 1 by respective tension springs 52 made of a conductive material. While charging is not effected, the charge roller 2 is held in an inoperative position indicated by a solid line in FIG. 10. In FIG. 10, the reference numeral 53 designates a stationary spring retainer to which one end of the spring 52 is anchored. When the charge roller 2 is in contact with the drum surface la, a bias voltage is applied from the power source 24 to the core 15 of the roller 2 via the conductive spring 52 and conductive bearing 17. As a result, the charge roller 2 charges the drum surface 1*a* uniformly.

An arm 55 is rotatably supported by a shaft 54 at substantially the intermediate point thereof. The charge roller 2 is rotatably supported by one end of the arm 55 via the conductive bearing 17. A solenoid 56 has a plunger 56*a* which is connected to the other end of the arm 55 via a spring 57. The solenoid 56 is affixed to a stationary part of the apparatus. When the solenoid 56 is not energized, the arm 55 remains in a position indicated by a solid line in FIG. 10 due to the action of the spring 56, maintaining the charge roller 2 spaced apart from the drum 1. When the solenoid 56 is energized, the arm 55 is rotated clockwise against the action of the spring 52 to a position indicated by a phantom line in FIG. 10. At this instant, the spring 57 is slightly stretched to allow the charge roller 2 to contact the drum surface 1*a* under a pressure adequate for charging.

The temperature sensor 20 responsive to the surface temperature of the charge roller 2 is located in the vicinity of the charge roller 2. The sensor 20 is fixed at a position where it contacts the surface of the charge roller 2 when the roller 2 is spaced apart from the drum 1 or does not contact it when the roller 2 is held in contact with the drum 1.

Figure 11:
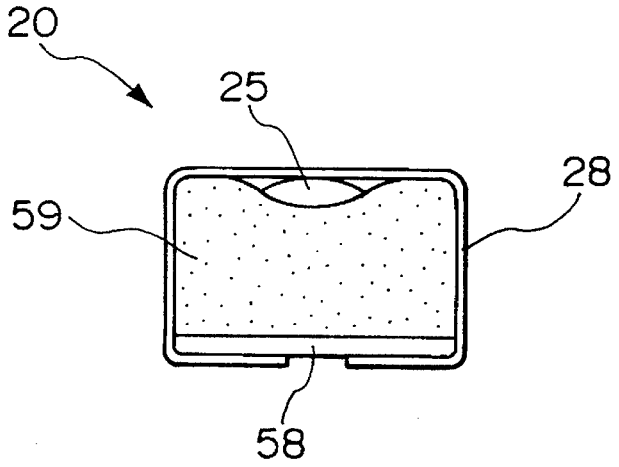
FIGS. 11 and 12 are respectively a section and a perspective view showing a temperature sensor included in the second embodiment.
Figure 12:
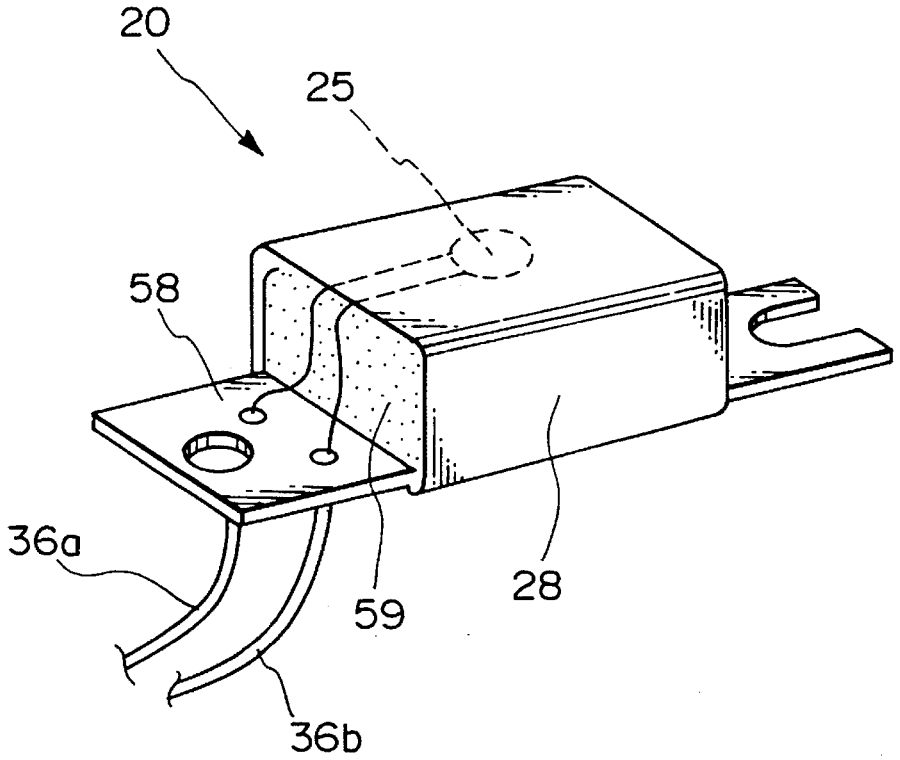

As shown in FIG. 11, the sensor 20 has a base 58 made of, for example, epoxy resin, and a cushion 59 of foam polyurethane laid on the base 58. As best shown in FIG. 12, the sensing element 25 is positioned at substantially the center of the upper surface of the cushion 59. An about 10

μm thick film 28 is made of polyimide amide and covers the sensor assembly from above the temperature sensing element 25. The film 28 plays the same role as the film 28 of the sensor 20 shown in FIGS. 3 and 4.

As shown in FIG. 10, the sensor 20 is fixed at a position where it contacts the surface of the charge roller 2 when the roller 2 is spaced apart from the drum 1, but it does not contact it when the roller 2 is held in contact with the drum 1, as stated above. Hence, the sensor 20 selectively moves into and out of contact with the charger roller 2 in association with the movement of the charge roller 2 relative to the drum 1. The illustrative embodiment, therefore, achieves the same advantages as the first embodiment.

3rd Embodiment

Figure 13:
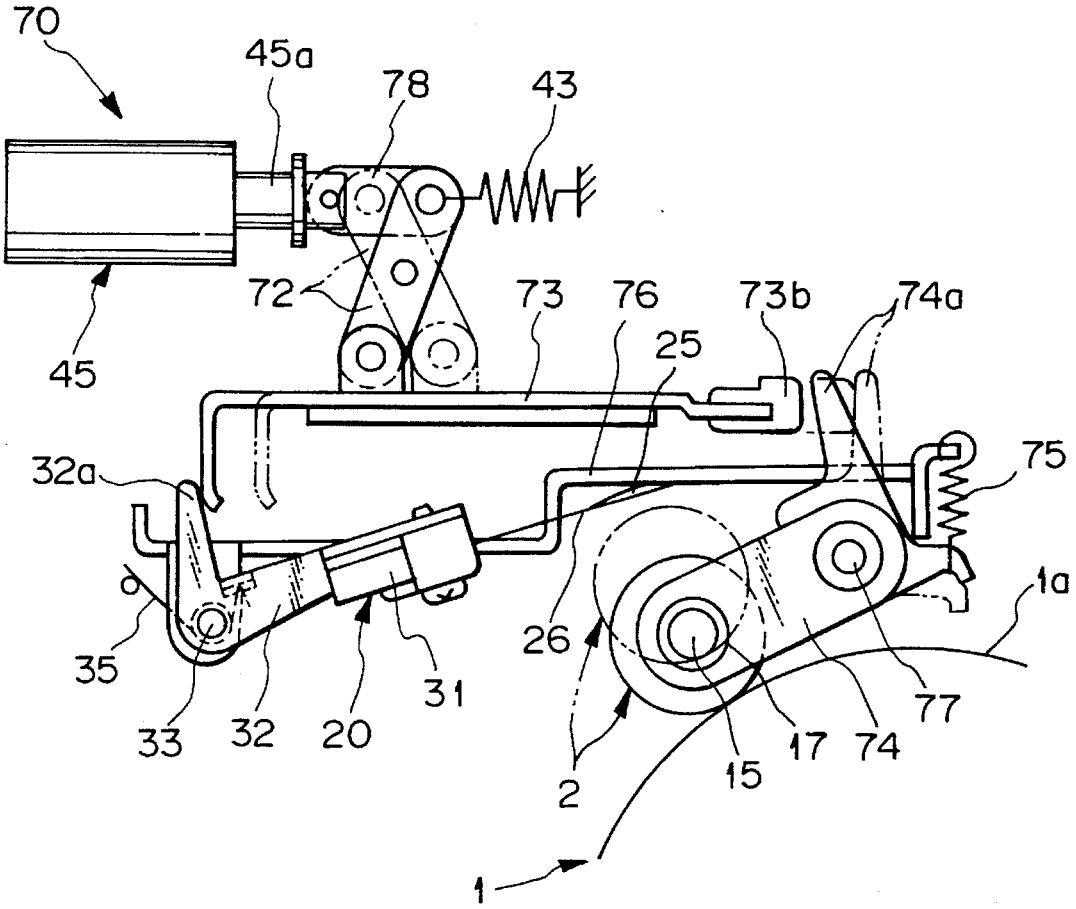
FIG. 13 shows third embodiment of the present invention including a charge roller, a temperature sensor and a mechanism for moving them at the same time.

FIG. 13 shows a third embodiment of the present invention which is characterized in that both the sensor 20 and the charge roller 2 are movable at the same time. In FIG. 13, the same or similar constituent parts as or to the parts shown in FIG. 2 are designated by the same reference numerals. Briefly, a moving mechanism 70 is constructed to selectively move the sensor 20 into contact with the charge roller 2 and, at the same time, move the charge roller 2 away from the drum surface 1 a or to move the sensor 20 away from the charge roller 2 and, at the same time, move the charge roller 2 into contact with the drum surface 1*a*. Specifically, a lever 74 is rotatably connected to a bracket 76 by a shaft 77. The charge roller 2 is rotatably supported by one end of the lever 74 via the bearing 17. In the position shown in FIG. 13, the charge roller 2 is held in contact with the drum surface 1*a* by a predetermined pressure due to the action of a tension spring 75 which is anchored at one end thereof to a spring retainer included in the lever 74.

The bracket 32, to which the sensor 20 is affixed, is rotatably supported by the bracket 76 via the shaft 33. That is, the sensor 20 and the charge roller 2 are retained by the common bracket 76 and maintained in a given positional relation thereby. A release lever 73 is movable only in the right-and-left direction as viewed in FIG. 13, i.e., between a solid line position and a phantom line position, thereby moving the sensor 20 and charge roller 2. An arm 72 has one end thereof pivotally connected to the upper surface of the release lever 73 by a shaft. The other end of the arm 72 is rotatably connected to a connecting plate 78 which is, in turn, connected to the plunger 45*a* of the solenoid 45. The tension spring 43 constantly biases the arm 72 clockwise, as viewed in FIG. 13.

When the solenoid 45 is not energized, the release lever 73 remains in the solid line position since the arm 72 is rotated by the tension spring 43. In this condition, the actuating end 73*a* of the release lever 73 urges the lever portion 32*a* of the bracket 32 to the left so as to rotate the bracket 32 counterclockwise. As a result, the sensor 20 mounted on the bracket 32 remains in the inoperative position where it is spaced apart from the charge roller 2, as shown in FIG. 13. A lug 74*a* extends out from the lever 74 while a cam 73*b* is affixed to the end of the lever 73. In the above condition, the lug 74*a* is slightly spaced apart from the cam 73*b*. Hence, the lever 74 is rotated by the tension spring 75 to the position shown in FIG. 13, so that the charge roller 2 is pressed against the drum surface la by a predetermined pressure due to the action of the tension spring 75.

When the solenoid 45 is turned on, the plunger 45*a* retracts into the solenoid 45, i.e., to the left as viewed in FIG. 13. As a result, the arm 72 pivots counterclockwise against the action of the tension spring 43, thereby moving the release lever to the phantom line position. Since the actuating end 73*a* of the release lever 73 moves away from the lever portion 32*a* of the bracket 32, the bracket 32 rotates clockwise due to the action of the torsion spring 35. Consequently, the sensor 20 is moved to the operative position where the sensing element 25 contacts the charge roller 2 via the film 28 (see FIG. 4). Further, the cam 73*b* of the release lever 73 moves to the phantom line position, urging the lug 74*a* of the lever 74 to the right. As a result, the lever 74 rotates clockwise against the action of the tension spring 75 and moves the charge roller 2 away from the drum surface 1*a*, as indicated by a phantom line in FIG. 13.

The solenoid 45 may be turned on and turned off at substantially the same timings as the solenoid 45, as demonstrated in FIG. 6.

Figure 14A:
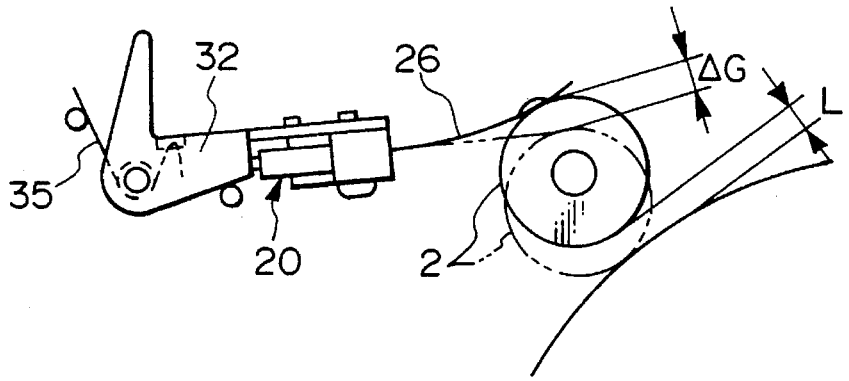
FIGS. 14A and 14B show how the temperature sensor can be fully spaced apart from the charge roller while minimizing a displacement required of the charge roller.
Figure 14B:
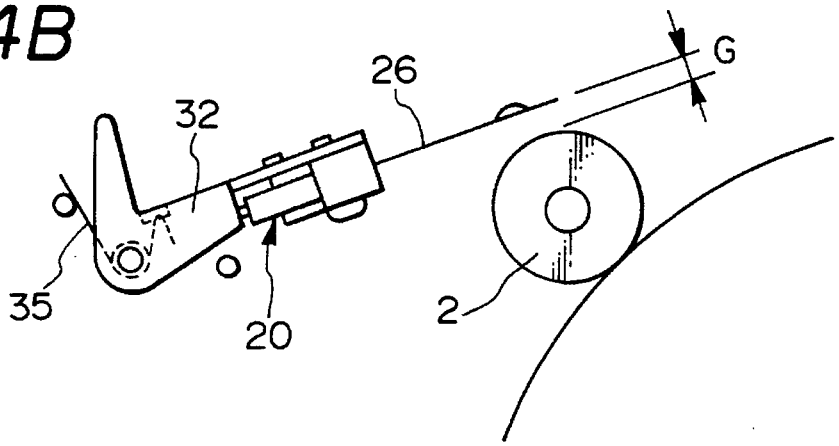
Figure 15A:
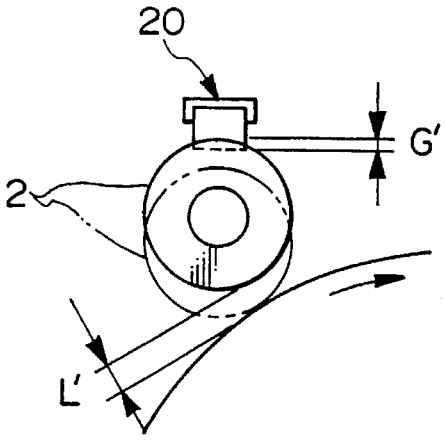
FIGS. 15A and 15B show an implementation for achieving the same object as in FIGS. 14A AND 14B, but with a different type of temperature sensor.
Figure 15B:
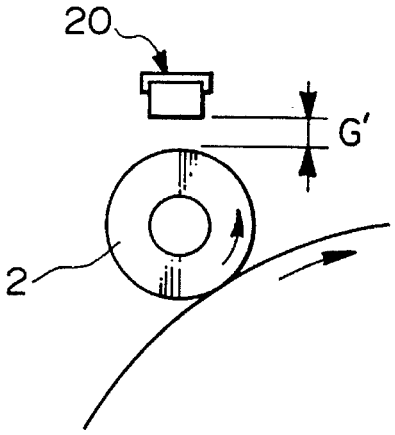

As stated above, the moving mechanism 70 selectively moves the sensor 20 into contact with the charge roller 2 and, at the same time, moves the charge roller 2 away from the drum surface 1*a* or moves the sensor 20 away from the charge roller 2 and, at the same time, moves the charge roller 2 into contact with the drum surface 1*a*. This successfully moves the sensor 20 fully away from the charge roller 2 while minimizing a displacement required of the charge roller 2. Specifically, as shown in FIGS. 14B or 15B, assume that the portion of the sensor 20 to contact the charge roller 2 and the surface of the charge roller 2 should be spaced apart by a distance G or G'. Also, assume that the sensor 20 is provided with an elastic displacement of $\Delta G$ or $\Delta G'$ in order to surely contact the charge roller 2. Then, should the charge roller 2 be moved alone to achieve the distance G or G', it would have to move over a distance $L=G+\Delta G$ or a distance $L'=G'+\Delta G'$.

In contrast, in the embodiment shown in FIG. 13, the sensor 20 is moved away from the charge roller 2 at the same time as the charge roller 2 is moved. Hence, assuming that a displacement greater than, for example, the elastic displacement $\Delta G$ is assigned to the sensor 20 itself, then such a displacement cancels a corresponding portion of the displacement of the charge roller 2. Hence, the charge roller 2 should only move a distance L which is equal to or even shorter than the distance G.

4th Embodiment

Figure 16:
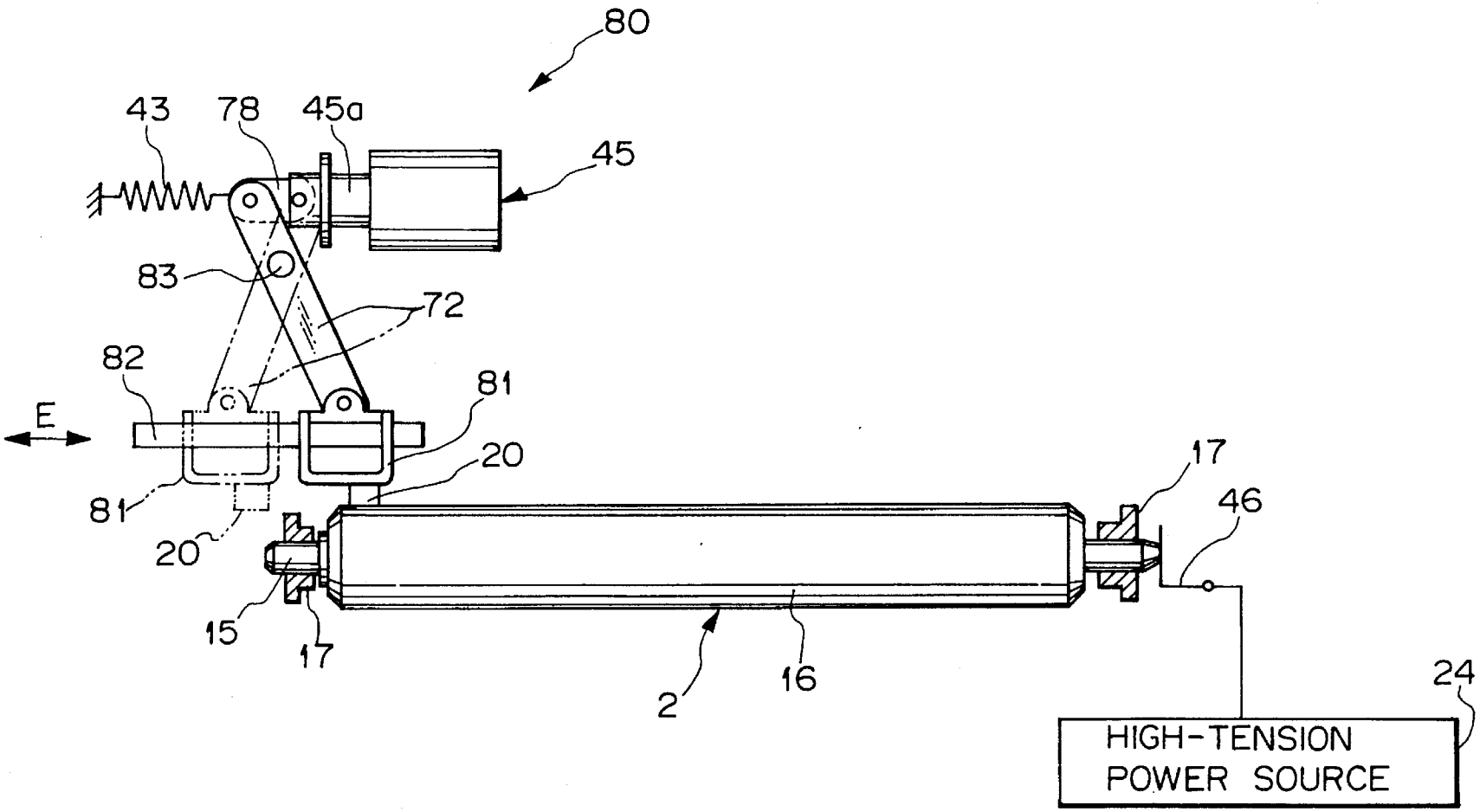
FIG. 16 shows a fourth embodiment of the present invention including a charge roller, a temperature sensor and a mechanism for moving the sensor away from the charge roller.

FIG. 16 shows a fourth embodiment of the present invention which is characterized in that the temperature sensor 20 is movable in the axial direction of the charge roller 2 to an inoperative position where it does not contact the roller 2. In FIG. 16, the same or similar constituent parts as or to the parts shown in FIGS. 8 and 9 are designated by the same reference numerals. Briefly, a moving mechanism 80 selectively moves the sensor 20 to an operative position indicated by a solid line or to an inoperative position indicated by a phantom line. As shown, the moving mechanism 80 has a bracket 81 supporting the sensor 20 on the underside thereof. The bracket 81 is slidable on and along a guide shaft 82, as indicated by an arrow E in FIG. 16. The arm 72 is pivotally connected at one end thereof to the upper end of the bracket 81 and at the other end to the connecting plate 78. The connecting plate 78 is connected to the plunger 45*a* of the solenoid 45. The arm 72 is rotatably supported by a shaft 83 at the intermediate point thereof.

When the solenoid 45 is turned on, the arm 72 is moved to a phantom line position shown in FIG. 16. As a result, the bracket 81 is moved to a phantom line position together with the sensor 20, thereby moving the sensor 20 away from the charge roller 2. When the solenoid 45 is turned off, the arm 72 is brought to a solid line position shown in FIG. 16 by the tension spring 43 which is anchored to the upper end of the arm 72. Consequently, the bracket 81 is moved to a solid line position together with the sensor 20, so that the sensor 20 is brought into contact with the charge roller 2.

5th Embodiment

Figure 17:
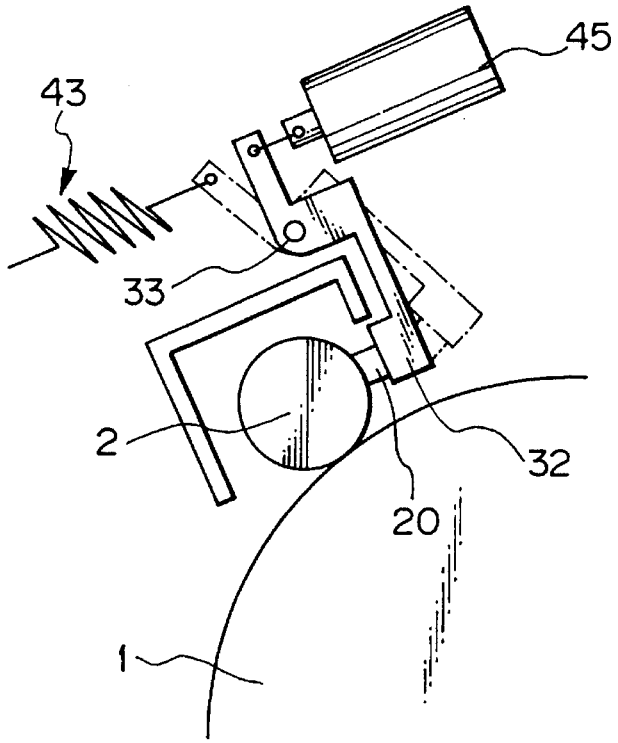
FIGS. 17, 18 and 19 are sections respectively showing a fifth, a sixth and a seventh embodiment of the present invention.

Referring to FIG. 17, a fifth embodiment of the present invention is shown. In FIG. 17, the same or similar constituent parts as or to the parts shown in FIG. 2 are designated by the same reference numerals. As shown, the sensor 20 is mounted on the lower end of the bracket 32 in such a manner as to face the charge roller 2. The bracket 32 is rotatably supported by the shaft 33 and movable between a solid line position and a phantom line position shown in FIG. 17. The tension spring 43 is anchored to the upper end of the bracket 32 to release the sensor 20 from the charge roller 2. The solenoid 45 is also connected to the upper end of the bracket 32 to press the sensor 20 against the charge roller 2 against the action of the spring 43. On the turn-on of the solenoid 45, it causes the bracket 32 to rotate clockwise, as viewed in FIG. 17, until the sensor 20 contacts the charge roller 2. In this condition, the sensor 20 is capable of sensing the temperature of the charge roller 2. When the solenoid 45 is turned off, the bracket 32 is rotated counterclockwise by the spring 43 and brought to the phantom line position where the sensor 20 is spaced apart from the charge roller 2.

In operation, assume that the print start key is pressed while the apparatus is in a stand-by state. Then, a controller, not shown, sends an ON signal to the solenoid 45 so as to turn it on. As a predetermined period of time expires since the generation of the ON signal, the controller samples the output of the sensor 20 held in contact with the charge roller 2, thereby obtaining the latest temperature data of the charge roller 2. Based on the temperature data, the controller determines a DC voltage to be applied to the charge roller 2. Subsequently, the controller sends an OFF signal to the solenoid 45 to turn it off. As a result, the sensor 20 is again moved away from the charge roller 2. Thereafter, the controller outputs a control signal for driving the drum 1 in order to execute a usual image forming process. Specifically, the temperature sensing operation completes before the rotation of the drum 1, and the charge roller 2 does not rotate when the sensor 20 is in contact with the roller 2. Hence, the charge roller 2 scarcely wears even when the sensor 20 is in contact therewith.

If desired, a pulse generator or similar rotation sensing means may be mounted on the charge roller 2. Then, it is possible to control the timinings for turning on and turning off the solenoid 45 and the timing for start sensing the temperature in response to the output of the rotation sensing means.

6th Embodiment

Figure 18:
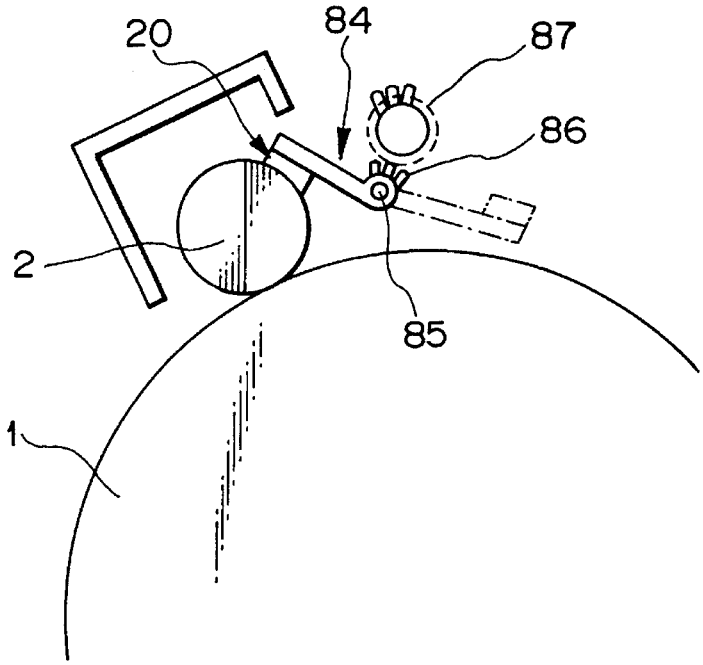

FIG. 18 shows a sixth embodiment of the present invention. In FIG. 18, the same or similar constituent parts as or to the parts shown in FIGS. 2 and 17 are designated by the same reference numerals. As shown, the temperature sensor 20 is mounted on one end of a rotatable member 84, the other end of which is supported by a shaft 85. The shaft 85 is formed with teeth 86 which are held in mesh with a drive gear 87. An electric motor, not shown, is drivably connected to the drive gear 87. Driven by the motor, the rotatable member 84 is rotatable over about 180 degrees between a first and a second position respectively indicated by a solid line and a phantom line in FIG. 18. When the rotatable member 84 is in the first position, the sensor 20 is capable of sensing the temperature of the charge roller 2 in contact therewith. When the rotatable member 84 is brought to the second position, the sensor 20 adjoins the surface of the drum 1 and can sense the temperature of the drum 1.

With this embodiment, therefore, it is possible to attain two different kinds of temperature data with a single temperature sensor. Usually, the rotatable member 84 is held in the second position to allow the sensor 20 to sense the temperature of the drum 1. Only when the temperature of the charge roller 2 should be sensed, the rotatable member 84 is moved to the first position.

7th Embodiment

Figure 19:
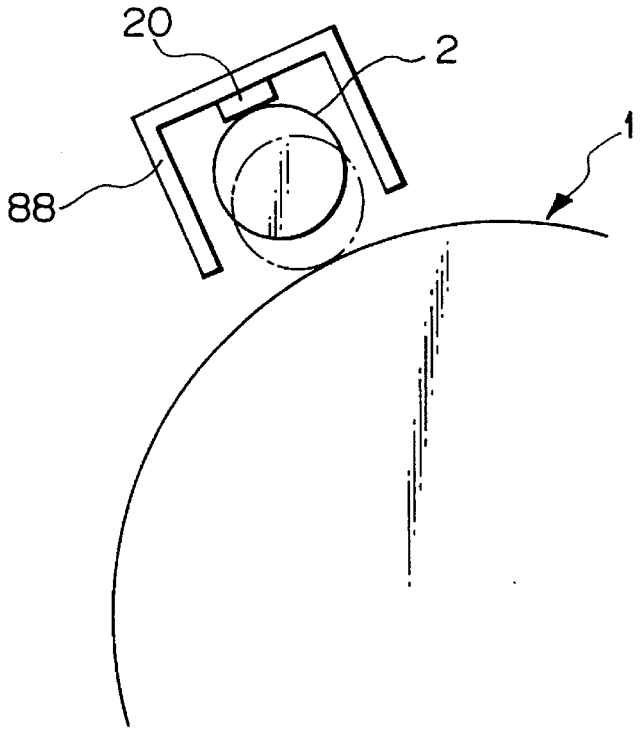

FIG. 19 shows a seventh embodiment of the present invention. In FIG. 19, the same or similar constituent parts as or to the parts shown in FIGS. 2, 17 and 18 are designated by the same reference numerals. As shown, the charge roller 2 is selectively movable to a solid line position where it is spaced part from the drum 1 or to a phantom line position where the former contacts the latter. The temperature sensor 20 is mounted on a bracket 88. When the charge roller 2 is held in the solid line position, it contacts the sensor 20 so as to have the temperature thereof sensed.

Figure 20:
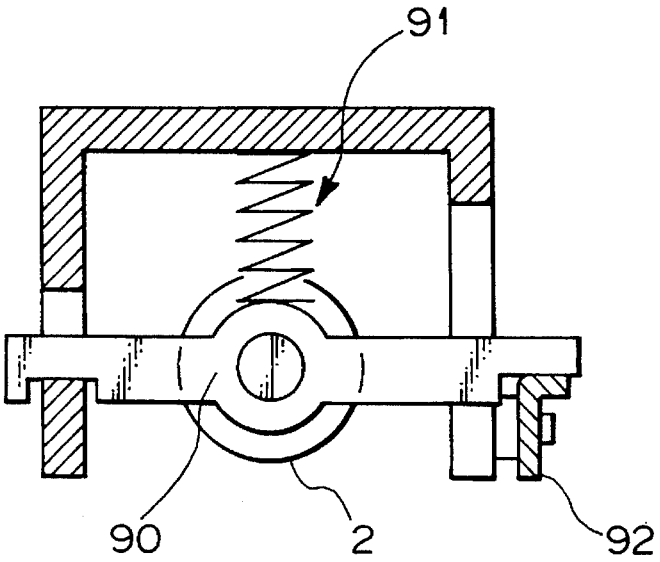
FIG. 20 shows a specific mechanism for moving a temperature sensor included in the seventh embodiment relative to a charge roller.
Figure 21A:
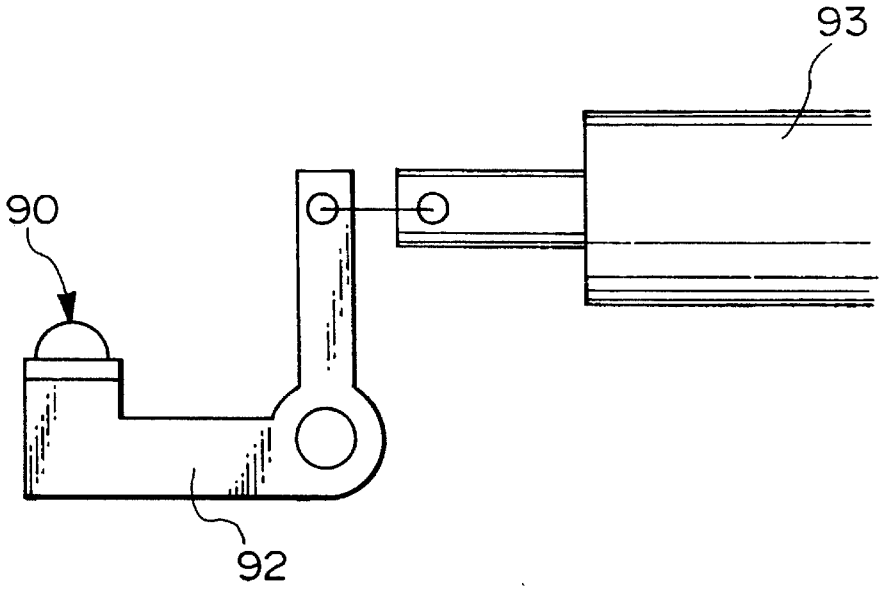
FIGS. 21A and 21B demonstrate the operation of the moving mechanism shown in FIG. 20.
Figure 21B:
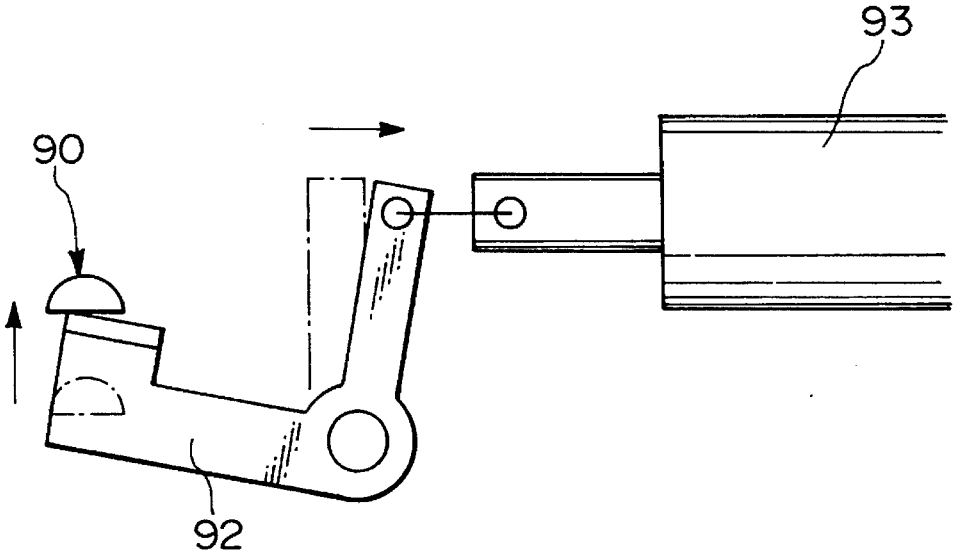

As shown in FIG. 20, a member 90 is coupled over the core of the charge roller 2 at opposite ends of the roller 2. The member 90 and, therefore, the charge roller 2 is constantly biased toward the drum 1 by a spring 91. The member 90 is supported at one end by the charge roller 2 and at the other end by a lever 92. As shown in FIGS. 21A and 21B, a solenoid 93 is connected to one end of the lever 92. When the solenoid 93 is turned on (FIG. 21B), the member 90 is raised with the result that the charge roller 2 is moved away from the drum 1 into contact with the sensor 20. On the turn-off of the solenoid 93 (FIG. 21A), the charge roller 2 is urged downward by the spring 91 to contact the drum 1. At the same time, the charge roller 2 is moved away from the sensor 20.

8th Embodiment

In this embodiment, the temperature sensor 20 is constantly spaced apart from the charge roller 2. Specifically, while the sensor 20 should preferably contact or adjoin the charge roller 2 in order to sense the temperature thereof, the embodiment locates the sensor 20 at a particular position where it can sense the temperature of the charge roller 2 most accurately without contacting the roller 2. Generally, as an image forming process is repeated, a lamp included in optics, not shown, generates heats. In light of this, a fan for ventilation is often located at the rear of an image forming apparatus. Hence, temperature around the charge roller 2 differs from the time when the fan is in operation to the time when it is out of operation. A series of experiments were conducted to determine a position where the sensor 20 was highly responsive to the surface temperature of the charge roller 2 without regard to the operation of the fan. The experiments showed that the highest response was achievable when the sensor 20 was located at, for example, the eraser 18 shown in FIG. 1 or 9. Locating the sensor 20 at the rear of the eraser 18 is not desirable since the temperature changes over a substantial range due to the operation of the fan. Also, locating the sensor 20 in the vicinity of a fixing unit or at the fixing unit side with respect to the charge roller 2 is not desirable since it is susceptible to heat generated by the fixing unit.

While all the embodiments shown and described have used a thermistor as temperature sensing means, it may be replaced with any other suitable temperature sensing means so long as it can transform temperature to an electric signal. For example, use may be made of a thermocouple, a resistor having platinum as a resistance element whose electric resistance changes with a change in temperature, or an IC (Integrated Circuit) sensor having a temperature coefficient of about 2.3 m V/°C. particular to the base-emitter forward voltage drop of a bipolar transistor and having an amplifier and output transistor packaged on a single silicone chip.

In the embodiments, the member to have the surface temperature thereof sensed in contact with a photoconductive element has been assumed to be a charge roller. The charge roller may, of course, be replaced with an image transfer member contacting the photoconductive element. In this connection, the transfer belt shown in FIGS. 1 and 9 may be replaced with a transfer roller. If an arrangement is made such that a voltage to be applied to the transfer member is controlled in response to the output of a temperature sensor responsive to the surface temperature of the transfer member, it is possible to transfer a toner image from the photoconductive element to a sheet in optimal conditions at all times without regard to the temperature around the apparatus.

Although the temperature sensor differs in configuration or structure from one embodiment to another, the function of sensing the surface temperature of the charge roller is common to all the embodiments. The advantages of the embodiments are not derived from the configuration or structure of the sensor, but they are derived from the overall construction of the apparatus.

When the member to which the embodiments pertain is implemented as a charging member, the charging member may be comprised of a belt, blade or brush in place of a roller. Even the photoconductive element may be implemented as a belt, if desired.

While the embodiments have concentrated on a temperature sensor, the image forming process is susceptible not only to temperature but also to, for example, humidity. Hence, a humidity sensor or similar sensor may be used in combination with or in place of the temperature sensor.

In summary, it will be seen that the present invention provides an image forming apparatus having various unprecedented advantages, as enumerated below.

(1) A voltage to be applied to a contact member, which contacts a photoconductive element, is controlled on the basis of the surface temperature of the contact member. Hence, even when the apparatus is operated at relatively low ambient temperature, a voltage corrected in matching relation to the surface temperature is applied to the contact member. Assuming that the contact member is a charging member, the corrected voltage provides it with a predetermined charge potential which prevents defective charging from occuring, thereby insuring attractive images with sufficient density. When the contact member is implemented as an image transfer member, the corrected voltage promotes efficient image transfer.

(2) The temperature sensor can be moved to a position where it does not contact the surface of the contact member. In such a position, the sensor does not contaminate the surface of the contact member. Further, noise due to rubbing is eliminated so long as the sensor is spaced apart from the contact member.

(3) When the sensor is held in contact with the contact member, no voltages are applied from voltage applying means to the contact member. Hence, there can be substantially fully obviated an occurrence that the temperature sensor is electrically effected by the voltage, and an occurrence that noise enters the control system of the entire apparatus to bring about various faults and malfunctions.

(4) The temperature sensor is located at a position where it contacts the contact member when the contact member is spaced apart from the photoconductive element or does not contact the contact member when the contact member contacts the photoconductive element either directly or via a paper. In this case, by using a mechanism for moving the contact member into and out of the contact with the photoconductive element in order to protect the contact member from the deposition of toner and impurities, it is possible to move the sensor into and out of contact with the contact member without resorting to a mechanism for moving the sensor. This successfully simplifies the construction and reduces the cost of the apparatus.

(5) A mechanism for moving the temperature sensor is so constructed as to move the contact member away from the photoconductive element at the same time as it moves the sensor into contact with the contact member or to move the contact member into contact with the photoconductive element as the same time as it move the sensor away from the contact member. In this construction, the sensor and the contact member are moved away from each other when the former is moved away from the latter. Hence, the displacement required of the contact member and, therefore, the overall dimensions of the apparatus are reduced.

(6) When the temperature sensor contacts the contact member outside of an effective image forming region, the former does not rub such a region of the contact member and, therefore, protects it from scratches.

Various modifications will become possible for those skilled in the art after receiving the teachings of the present disclosure without departing from the scope thereof.

What is claimed is:

1. An image forming apparatus comprising:

a photoconductive element;

a contact member applied with a voltage in contact with said photoconductive element;

voltage applying means for applying the voltage to said contact member;

temperature sensing means for sensing a surface temperature of said contact member;

control means for controlling the voltage to be applied from said voltage applying means to said contact member in response to an output of said temperature sensing means; and moving means for selectively moving said temperature sensing means to a contact position where said temperature sensing means contacts a surface of said contact member or to a non-contact position where said temperature sensing means does not contact said contact member;

wherein an application of the voltage to the contact member is controlled based on whether the temperature sensing means is in the contact Position or the non-contact position.

2. An image forming apparatus comprising:

a photoconductive element;

a contact member applied with a voltage in contact with said photoconductive element;

voltage applying means for applying the voltage to said contact member;

temperature sensing means for sensing a surface temperature of said contact member;

control means for controlling the voltage to be applied from said voltage applying means to said contact member in response to an output of said temperature sensing means; and moving means for selectively moving said temperature sensing means to a contact position where said temperature sensing means contacts a surface of said contact member or to a non-contact position where said temperature sensing means does not contact said contact member;

wherein said control means controls said voltage applying means such that said voltage applying means does not apply the voltage to said contact member when said temperature sensing means is located at said contact position.

3. An image forming apparatus comprising:

a photoconductive element;

a contact member applied with a voltage in contact with said photoconductive element;

voltage applying means for applying the voltage to said contact member;

temperature sensing means for sensing a surface temperature of said contact member;

control means for controlling the voltage to be applied from said voltage applying means to said contact member in response to an output of said temperature sensing means; and moving means for selectively moving said temperature sensing means to a contact position where said temperature sensing means contacts a surface of said contact member or to a non-contact position where said temperature sensing means does not contact said contact member;

wherein said moving means moves said contact member away from a surface of said photoconductive element when moving said temperature sensing means to said contact position or moves said contact member into contact with said surface of said photoconductive element when moving said temperature sensing means to said non-contact position.

4. An image forming apparatus comprising:

a photoconductive element;

a contact member applied with a voltage in contact with said photoconductive element;

voltage applying means for applying the voltage to said contact member;

temperature sensing means for sensing a surface temperature of said contact member;

control means for controlling the voltage to be applied from said voltage applying means to said contact member in response to an output of said temperature sensing means; and moving means for selectively moving said temperature sensing means to a contact position where said temperature sensing means contacts a surface of said contact member or to a non-contact position where said temperature sensing means does not contact said contact member;

wherein said temperature sensing means contacts said contact member outside of an effective image forming region.

5. An apparatus as claimed in claim 1, wherein said contact member comprises a charging member for charging, in contact with the surface of said photoconductive element, said photoconductive element by being applied with the voltage from said voltage applying means.

6. An apparatus as claimed in claim 1, wherein said contact member comprises an image transfer member for transferring, in contact with the surface of said photoconductive element, a toner image from said photoconductive element to a paper by being applied with the voltage from said voltage applying means.

7. An image forming apparatus comprising:

a photoconductive element;

a contact member applied with a voltage in contact with said photoconductive element;

voltage applying means for applying the voltage to said contact member;

temperature sensing means for sensing a surface temperature of said contact member;

control means for controlling the voltage to be applied from said voltage applying means to said contact member in response to an output of said temperature sensing means; and moving means for selectively moving said temperature sensing means to a contact position where said temperature sensing means contacts a surface of said contact member or to a non-contact position where said temperature sensing means does not contact said contact member;

wherein said temperature sensing means comprises a contact portion contacting said contact member and having a same hardness as the surface of said contact member.

8. An image forming apparatus comprising:

a photoconductive element;

a contact member applied with a voltage in contact with said photoconductive element;

moving means for selectively moving said contact member into or out of contact with said photoconductive element;

voltage applying means for applying the voltage to said contact member;

temperature sensing means for sensing a surface temperature of said contact member; and control means for controlling the voltage to be applied from said voltage applying means to said contact member in response to an output of said temperature sensing means;

said temperature sensing means being located at a position where said temperature sensing means contacts a surface of said contact member when said contact member and said photoconductive element are spaced apart from each other or does not contact said surface when said contact member and said photoconductive element are held in contact with each other.

9. An apparatus as claimed in claim 8, wherein said temperature sensing means contacts said contact member outside of an effective image forming region.

10. An apparatus as claimed in claim 8, wherein said contact member comprises a charging member for charging, in contact with the surface of said photoconductive element, said photoconductive element by being applied with the voltage from said voltage applying means.

11. An apparatus as claimed in claim 8, wherein said contact member comprises an image transfer member for transferring, in contact with the surface of said photoconductive element, a toner image from said photoconductive element to a paper by being applied with the voltage from said voltage applying means.

12. An image forming apparatus comprising:

a photoconductive element;

a rotatable contact member applied with a voltage in contact with said photoconductive element;

voltage applying means for applying the voltage to said contact member;

temperature sensing means for sensing a surface temperature of said contact member;

control means for controlling the voltage to be applied from said voltage applying means to said contact member in response to an output of said temperature sensing means; and moving means for moving said temperature sensing means and said contact member relative to one another such that said contact member does not contact said temperature sensing means when said contact member is rotated.

13. An image forming apparatus comprising:

a photoconductive element;

a contact member applied with a voltage in contact with said photoconductive element;

voltage applying means for applying the voltage to said contact member;

temperature sensing means for sensing a surface temperature of said contact member;

control means for controlling the voltage to be applied from said voltage applying means to said contact member in response to an output of said temperature sensing means; and moving means for moving said temperature sensing means and said contact member relative to one another such that said temperature sensing means does not contact said contact member when a voltage is applied to said contact member.

14. An image forming apparatus comprising:

a photoconductive element;

a rotatable contact member applied with a voltage in contact with said photoconductive element;

voltage applying means for applying the voltage to said contact member;

temperature sensing means for sensing a surface temperature of said contact member;

control means for controlling the voltage to be applied from said voltage applying means to said contact member in response to an output of said temperature sensing means; and moving means for selectively moving said temperature sensing means to a contact position where said temperature sensing means contacts a surface of said contact member or to a non-contact position where said temperature sensing means does not contact said contact member, such that the temperature sensor does not contact the contact member when the contact member is rotated.

15. An image forming apparatus comprising:

a photoconductive element;

a rotatable contact member applied with a voltage in contact with said photoconductive element;

voltage applying means for applying the voltage to said contact member;

temperature sensing means for sensing a surface temperature of said contact member;

control means for controlling the voltage to be applied from said voltage applying means to said contact member in response to an output of said temperature sensing means; and moving means for moving said contact member such that said contact member does not contact said temperature sensing means when said contact member is rotated.

16. An image forming apparatus comprising:

a photoconductive element;

a contact member applied with a voltage in contact with said photoconductive element;

voltage applying means for applying the voltage to said contact member;

temperature sensing means for sensing a surface temperature of said contact member;

control means for controlling the voltage to be applied from said voltage applying means to said contact member in response to an output of said temperature sensing means; and moving means for moving said contact member such that said contact member does not contact said temperature sensing means when a voltage is applied to said contact member.

* * * * *